US006440053B1

(12) United States Patent
Niedermeyer

(10) Patent No.: US 6,440,053 B1
(45) Date of Patent: Aug. 27, 2002

(54) APPARATUS FOR FOLDING PLURALITIES OF PRODUCT WEBS ADVANCING ALONG PARALLEL PATHS

(76) Inventor: William P. Niedermeyer, 1024 Mt. Mary Dr., Green Bay, WI (US) 54311

( * ) Notice: Subject to any disclaimer, the term of this patent is extended or adjusted under 35 U.S.C. 154(b) by 214 days.

(21) Appl. No.: 09/617,895

(22) Filed: Jul. 17, 2000

Related U.S. Application Data

(63) Continuation-in-part of application No. 09/576,060, filed on May 20, 2000, now Pat. No. 6,375,605, and a continuation-in-part of application No. 09/499,242, filed on Feb. 7, 2000, and a continuation-in-part of application No. 09/481,108, filed on Jan. 11, 2000, now Pat. No. 6,359,223.

(51) Int. Cl.[7] ..... B31F 1/00

(52) U.S. Cl. ..... 493/416; 493/418; 493/419; 493/422

(58) Field of Search ..... 493/416, 418, 493/419, 422, 428, 450

(56) References Cited

U.S. PATENT DOCUMENTS 3,689,061 A * 9/1972 Nystrand
5,004,451 A * 4/1991 Prum ..... 493/418
5,147,273 A * 9/1992 Rottmann et al. ..... 493/418
5,904,277 A * 5/1999 Niedermeyer ..... 493/416

* cited by examiner

*Primary Examiner*—Rinaldi I. Rada
*Assistant Examiner*—Sameh Tawfik

(57) ABSTRACT

Vacuum folding apparatus to make longitudinal and transverse folds in product width webs for folded napkins using a plurality of full speed web feed and cutoff anvil/knife roll couples each to process a portion of product webs slit from a wide parent web. The preferred apparatus includes two or more cutoff units in circumferentially spaced contact with a carrier cylinder having a hollow cylinder with shaped vacuum conduits attached to the inside surface and cooperating with pluralties of anvil/knife rolls having drilled conduits and valve means to control vacuum independently for each plurality of webs being processed. Intermediate between frame members support one end of multi-width anvil/knife roll couples. In another embodiment, the plurality of units to feeds, cuts, and transfers single width product segments at full speed for processing multiple juxtaposed webs being advanced along parallel paths In another embodiment, two or more pluralties of product width feed and cutoff roll couples are each supporteds by interframe members and operate at reduced speed requiring two or more parent roll unwind stands each operating at reduced speed for a cummulative speed equal to folder processing speed.

18 Claims, 7 Drawing Sheets

W
2
4
5
6
7
8
9
30
PN
3
3
P1
PN
10
P2
6
6
15
17
16
20
20'
18
21
19
22
23
26
27
17'
16'
18'
3
28
V2
V1
R
29
29'
13
11
14
1
22N
27
28
F1
F1'
26
22

FIG. 7
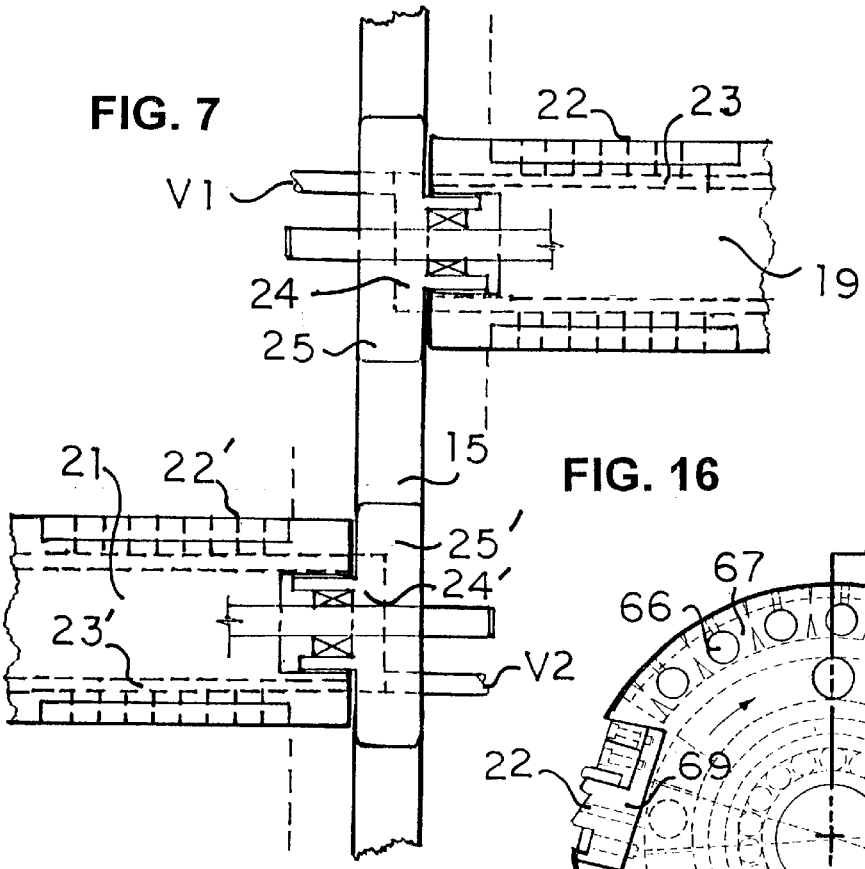
FIG. 16
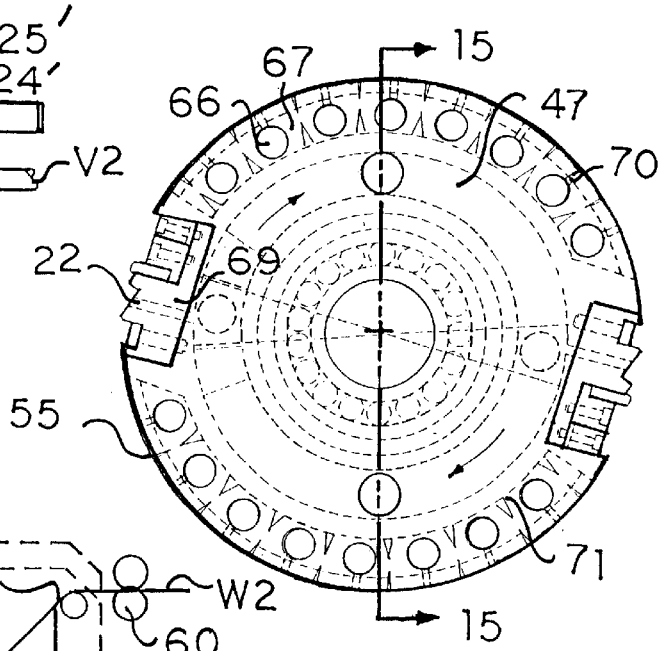
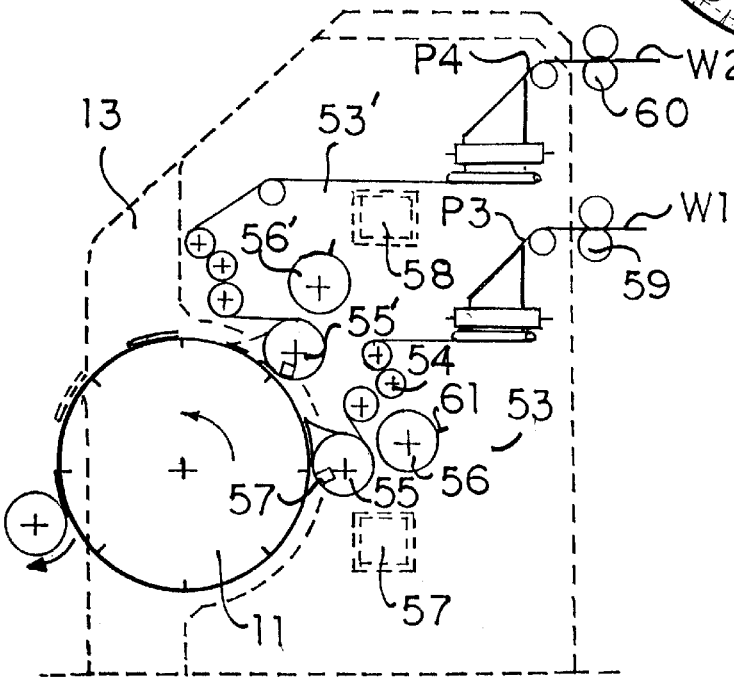
FIG. 13

$P_N$
12
13
19
19'
20'
22
23
33
34
35
36
40
41
42
43
44
45
45'
46
47
48
49
50
51
52
52'
V

APPARATUS FOR FOLDING PLURALITIES OF PRODUCT WEBS ADVANCING ALONG PARALLEL PATHS

This application is a Continuation-In-Part of Ser. No. 09/576,060 filed May 20, 2000 as U.S. Pat. No. 6,375,605 and is Continuation-In-Part of Ser. No. 09/499,242, filed Feb. 7, 2000 and is a Continuation-In-Part of Ser. No. 09/481,108 filed Jan. 11, 2000 U.S. Pat. No. 6,350,223.

BACKGROUND OF THE INVENTION

Conventional vacuum folders according to the teachings of Christman U.S. Pat. No. 1,974,149 and Nystrand U.S. Pat. No. 3,689,061 include an anvil roll and coacting knife roll to cut segments which are transferred to a carrier roll.

In prior art folders, anvil roll vacuum holds, rotates, and uplifts the leading portion of a segment while a carrier roll holds, rotates the remaining portion with vacuum ports along a transverse line at the midpoint and advances the trailing portion until a fold is completed.

Current products, for example, luncheon and dinner napkins have nominal sizes of about 12×12" and 17×17" respectively, and typically, rolls used for folding usually have two repeat lengths around the circumference (2-time) for a range of roll diameters from about 8" to almost 11" for wider machines.

In state of the art folders, coacting roll pairs in this typical range are made from solid roll blanks drilled from one or both roll ends to provide vacuum conduits which communicate with surface ports and a vacuum source.

Because a pair of vacuum rolls must cooperate to complete a fold, a ratio of anvil:carrier roll diameters of 1.0 to 1.5 generally provides good folding results, but also defines roll and resultant folder limitations. For example, within this range of ratios, rolls have limited length and 'working' face width, limited cross sectional area requiring limited conduit size and vacuum suction, limits to the length of drilled holes for a pre-selected diameter, diminished vacuum suction in the middle lanes of multi-width machines, and less rigidity to insure proper shearing pressure between anvils and blades without excessive deflection.

Dynamic vibrations at speeds above 250–300 rpm can cause uneven cuts at segment ends.

In present folders, maximum rotary speed is limited primarily because of limited diameters and restricted cross sectional area of conduits that limit vacuum suction. Maximum roll widths for a 2-time roll are primarily limited by vacuum force, deflection and dynamic vibrations.

Total folder production at maximum speed is limited to the maximum roll length without deflection or vibration, and the maximum folder width (roll length) determines the total number of products processed per unit of time from parallel delivery lanes.

Artisans and the prior art do not explain how solid rolls with drilled conduits can be lengthened or how deflection can be avoided without increasing roll diameters and adding substantial weight requiring heavier frames, bearings, drive Hp, and related higher material costs, etc.

The invention solves these contrary and vexing requirements by describing hollow carrier cylinders having internal closed conduit shapes in combination with standard diameter solid anvil/knife rolls supported by intermediate framework in several arrangements described below.

In the preferred embodiment of FIG. 1, a large diameter carrier cylinder with interior conduits coacts with two or more juxtaposed, circumferentially spaced cutoff units having standard solid rolls for feed, cutoff and placement of segments at full web speed.

In another embodiment of FIG. 8, a web is advanced at full speed, slit to product widths, and a plurality if 1-wide juxtposed cutoff units are mounted for transverse support by cross members between side frames to cut and transfer product width segments to a large diameter multiwidth carrier cylinder.

In another embodiment of FIG. 13, full width pluraltiies of cutoff units are arranged along at least two transverse spaced lines and accept product width slit webs at slower speed to cut and transfer segments to alternate surfaces of the cooperating carrier cylinder.

Folders with wider hollow carrier cylinders and standard anvil/knife rolls can now match the width of webs ex-paper machine and thus eliminate pre-converting slit and rewind processing of parent rolls used by the folders.

In addition, by metering a plurality of webs to advance at at slow speed from two or more cutoff units, one or more additional parent rolls are added to increase the run time of each parent roll and the time between parent roll changes thereby increasing machine 'uptime' and productivity per shift.

Beneficial results from this invention include production of stacks having alternating colors and other color combinations as described in U.S. application Ser. No. 09/576060.

SUMMARY OF THE INVENTION

This Continuation-in-Part application defines a combination of folding apparatus elements, some previously described in co-pending U.S. patent applications Ser. No. 09/4,811,108, U.S. Pat. No. 6,350,223, Ser. No. 09/499,242 and Ser. No. 09/576,060.

The folding apparatus described herein includes a carrier cylinder with internal conduits of U.S. application Ser. No. 481108, solid anvil rolls as practiced in state of the art machines, anvil roll support means intermediate the side frames according to the teaching of Ser. No. 09/499242, and cutoff unit arrangements not heretofore used in prior art folding apparatus.

In summary, an object of this invention is to provide a hollow carrier cylinder with internal conduits to apply vacuum to a transverse line of ports under the midway fold line between segment ends.

Another object is to provide a folding apparatus having a carrrier cylinder with formed ir pre-molded internal conduits conduits attached to the inside surface and coacting with a standard solid anvil roll having vacuum conduits drilled according to current practice.

An object is to provide rolls having a ratio of diameters between the solid anvil roll and a larger diameter carrier cylinder wherein rotation of a solid anvil roll is about 90 degrees maximum from the nip between the anvil and carrier rolls to insure proper foldover while the carrier advances the trailing panel one half the unfolded product length.

Another object is to provide carrier cylinder internal vacuum conduits with increased area and capacity to allow for larger vacuum apertures in the surface.

An object of this invention is to provide anvil rolls having an operable ratio of diameters with the coacting carrier cylinder and maintaining the same roll ratio for processing webs of different widths.

A further object is to provide 1-wide cutoff assemblies including anvil rolls with drilled vacuum conduits and having a frame width that does not exceed the longitudinally folded web width by more than about 4"

Another object is to provide cutoff unit side frames having vacuum groove retention flanges that do not extend beyond the outer roll surface of an anvil roll mounted therein.

Another object is to provide a vacuum source connection perpendicular to the axis of vacuum conduits.

An object of this invention is to provide interchangeable and standardized metering/cutoff units for transverse mounting of a plurality including one cutoff unit per folded web.

Another object is to provide an intermediate cross frame support and a carrier roll wider than the web being processed to allow for future addition of additional cutoff units to process wider than original webs.

In a related embodiment, an object of this invention is to provide a carrier cylinder of sufficient diameter without excessive weight such that a second plurality of cutoff units (metering, anvil, knife rolls) can be mounted for operation along a second transverse line circumferentially spaced at least one carrier repeat surface from the first plurality.

Another object is to provide internal carrier cylinder conduits to complete a single transverse fold along one or more transverse lines in cooperation with a vacuumized anvil roll and a second transverse fold by air blast through apertures in the carrier surface in cooperation with a non-rotating folding plate.

Another object is to provide two or more between frame supports and two or more pluralities of single product width cutoff units to cut segments from alternate webs being fed at speeds slower than the surface speed of the anvil roll in order to prolong the run time for each of two or more parent rolls being used.

An object of this invention is to provide for a running adjustment of cutting contact between the coacting knife and anvil blade (s).

A further object is to provide a movable support means for nip and running adjustment between the anvil roll and the carrier cylinder An object of this invention is to provide coacting 2-time anvil and knife rolls having only a single anvil and knife coacting each revolution to extend the blade life and minimize adjustment frequency between rolls.

Other advantages and objects are illustrated and described in the ensuing specifications.

BRIEF DESCRIPTION OF THE DRAWINGS

FIG. 7 is an enlarged plan view of the intermediate frame mounting arrangement of FIG. 6 illustrating anvil roll containment cartridges contained within circular cutouts in the intermediate frame.

FIG. 13 is a side elevation schematic of an embodiment that processes two full width webs from two parent rolls illustrating separate longitudinal folding and web feed-cutoff means for each product width web slit from two full width incoming webs.

FIG. 16 is an enlarged end elevation of the high and low vacuum anvil roll of FIG. 15.

DETAILED DESCRIPTION

Figures 1, 2:
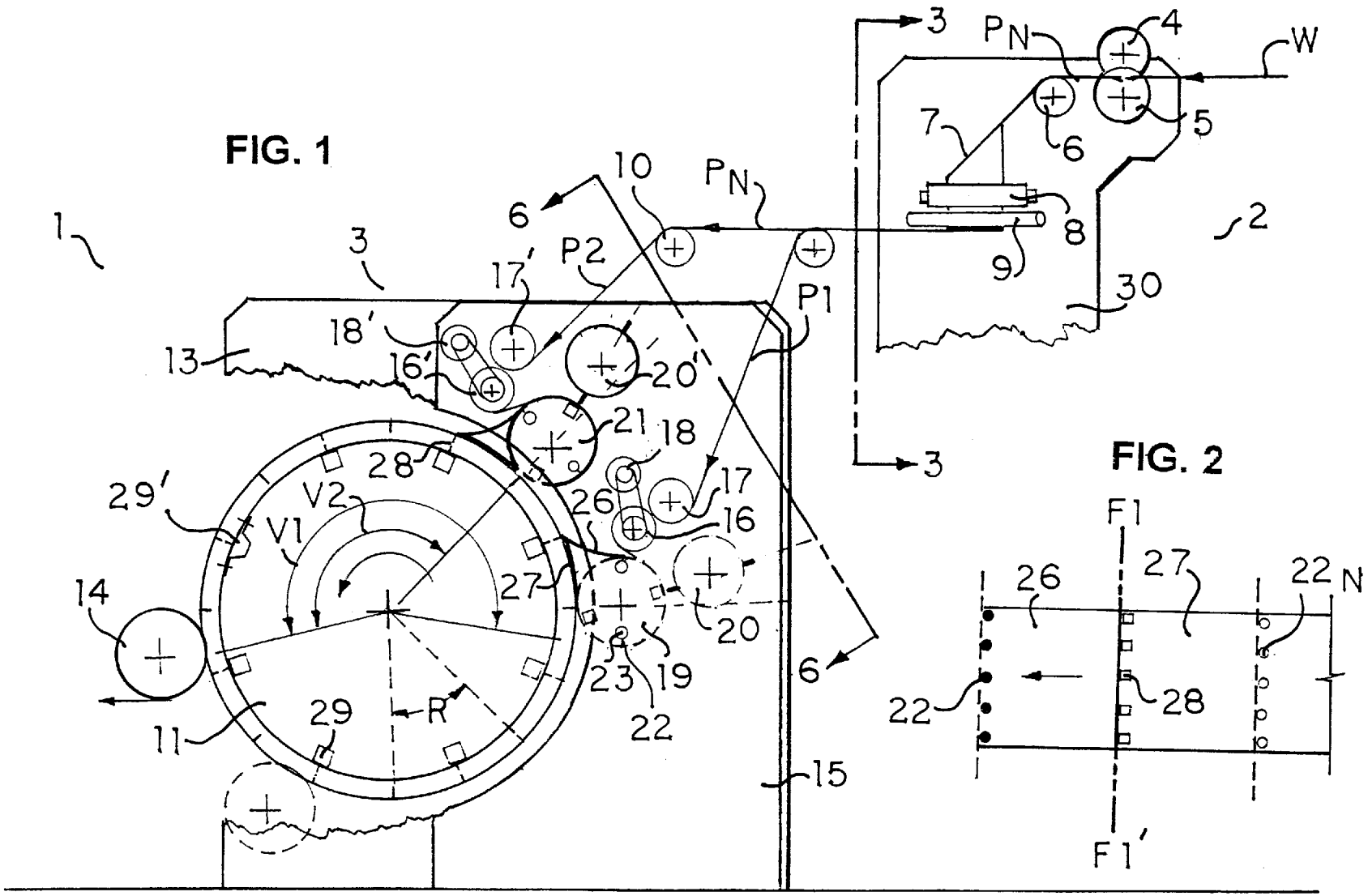
FIG. 1 is a side elevation cross-sectional schematic of a vacuum folder viewed from sight line 1—1 of FIG. 6 illustrating a plurality of web feed and cutoff units coacting with a carrier cylinder having independent interior conduits mounted on the inside surface to produce transverse folds in two or more juxtaposed web portions slit from a single web.
FIG. 2 is a plan view of a segment illustrating typical location of vacuum attachment areas at the leading edge and midway along a fold line.
Figure 3:
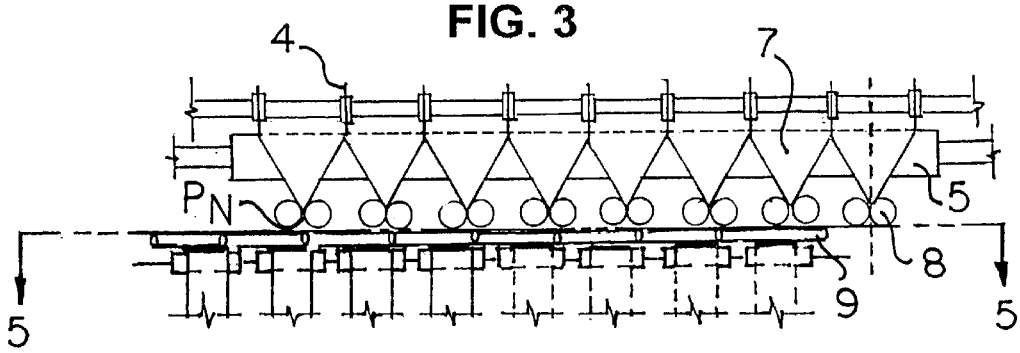
FIG. 3 is a side view from 3—3 of FIG. 1 illustrating components to slit a web into product widths, fold, meter and advance the longitudinally folded webs to transverse folding apparatus.

In FIG. 1, folding apparatus 1 is comprised of longitudinal slitting and folding section 2 and transverse folding section 3.

On the right side, web W is advanced from a parent roll unwind stand (not shown) through a plurality of web slitter blades 4 and slitter anvils 5 to form a plurality of product width slit webs $P_n$ which pass over guide roll 6 to the surface of longitudinal folding plate 7.

After being advanced over plate 7 by draw rolls 8, a plurality of folded product webs $P_n$ advances around turning bars 9 for advancement over guide rolls 10 by draw rolls in transverse folding section 3.

In transverse folding section 3, carrier cylinder 11 is rotatably supported between frames 12, 13.

At least one intermediate partial frame 15 is used to support a pluralirty of feed rolls 16, 16' and cooperating S-wrap rolls 17, 17' to meter a plurality of folded webs for advancement by lower anvil roll 19, and upper anvil roll 21

Knifes in rolls 20, 20' engage anvil blades to cut segments for subsequent advancement to the surface of carrier 11. Separate motors 18, 18' or gearing transmission from the carrier cylinder can be used to drive feed rolls.

In the example of FIG. 1, a lower cutoff unit (shown phantom to agree with the right hand side of FIG. 6) includes a 2-time solid anvil roll 19 and a 2-time solid knife roll 20.

In FIG. 1, the lower cutoff unit comprising rolls 19 and 20 is circumferentially spaced from upper unit 21, 20' a distance equal to one repeat surface of carrier cylinder 11 and operates in tandem with the upper unit, each at surface speedmatch with the carrier cylinder.

Referring briefly to FIG. 7, vacuum ports 22' drilled in the surface of anvil roll 19 and upper roll 21 connect to vacuum conduits23 in roll 19 and 23' in roll 21.

Drilled conduits 23 communicate with grooves 24 in vacuum valve 25 as roll 19 rotates, and conduits 23' operate in the same manner as roll 21 rotates in sliding contact with valve 25'

Reference FIG. 1, panel 26 of each segment is held by the anvil roll along a leading edge by ports 22 (see FIG. 2) and is uplifted as roll 19 rotates, while trailing portion 27 (secured to the surface of carrier 11 by ports 28 along fold line F1–F1 ') advances as carrier 11 rotates to complete a transverse fold when anvil vacuum expires.

In FIG. 1 and referring to FIGS. 3–6, a parent web W is slit into a plurality of product webs $P_n$.

In the illustrated example, eight juxtaposed webs are divided into multiweb streams $P_1$ and $P_2$, each with four adjacent longitudinally half folded webs.

In FIG. 1, carrier cylinder 11 has eight product repeat surfaces R and interior closed conduits 29 to conduct vacuum to surface ports 28 along fold lines F1–F1'.(see also FIG. 2)

In FIG. 1, carrier cylinder conduits 29 have end inserts (not shown) with openings that slidably communicate with vacuum grooves in a vacuum valve butting against the end of the cylinder 11.

In FIG. 1, vacuum V1 is applied through transversely aligned ports in the surface of carrier 11 (as at 28 of FIG. 2) to hold the trailing portion 27 while leading portion 28 is folded over by roll 19.

In FIG. 1, vacuum V2 is similarly applied to ports 28 in the carrier surface to hold segments along a fold line (as at F1–F1' of FIG. 2) while the leading portion is folded over by roll 21 positioned downstream and circumferentially spaced from roll 19.

The alternate conduit embodiment 29' shown prior to takeaway roll 14 is shaped to form a closed conduit after attachment ot the inside surface of carrier 11 and includes the end insert referred to above.

In FIG. 2, product repeat R includes front panel 26 and rear panel 27. Ports 22 are placed adjacent anvils along a leading edge of a segment and ports 28 along a transverse line in the carrier cylinder to V-fold a segment at fold line F1–F1'. Ports $22_n$ repesent leading edge ports holding subsequent segments in a series.

Figure 4:
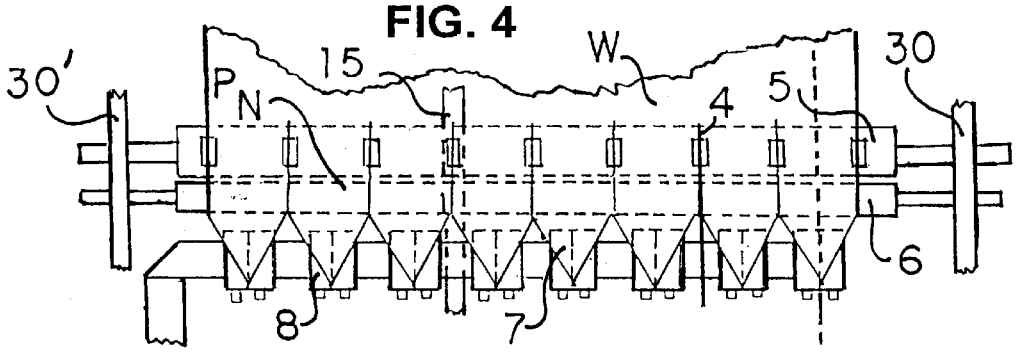
FIG. 4 is a plan view of FIG. 3 illustrating transverse slitters, folding plates, and draw rolls.
Figure 5:
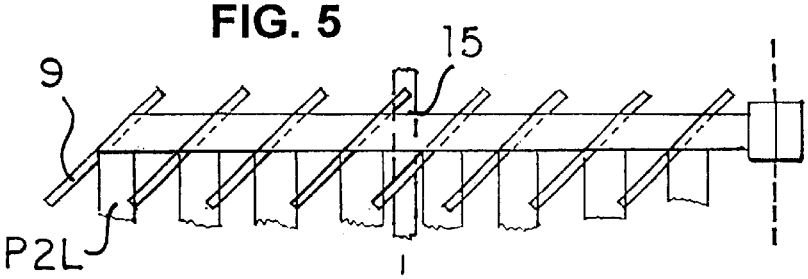
FIG. 5 is a plan view of turning bars viewed from sight line 5—5 of FIG. 3 illustrating the folded web offset after advancement from the folding plate draw rolls.
Figure 6:
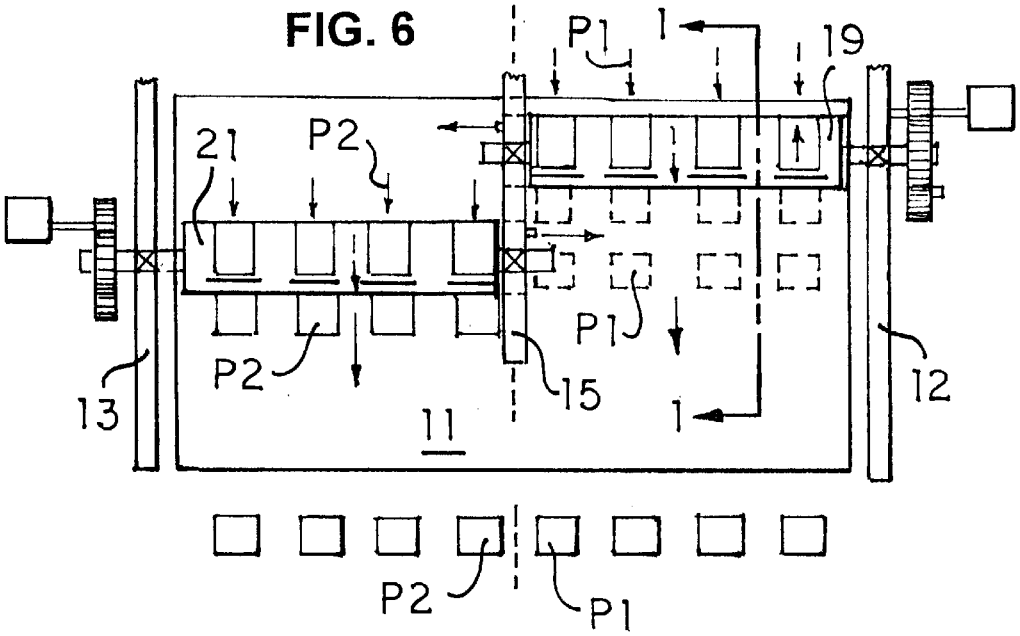
FIG. 6 is plan-like schematic viewed from sight line 6—6 of FIG. 1 illustrating a carrier cylinder and two anvil rolls mounted between side frames and intermediate framework, illustrating pre-selected portions of the web plurality processed by a first roll and the remaining portions processed by a second circumferentially spaced apart roll. Metering and knife rolls are omitted for clarity.

In FIGS. 3–6, the slitters, longitudinal folding plates, draw rolls and turning bars of FIG. 1 are arranged to slit a full width parent web W into a plurality of webs $P_n$, a portion $P_1$ for processing by anvil roll 19, and a second portion $P_2$ by roll 21 (Feed rolls 16, 17, and knife rolls 20 are omitted in FIG. 6 for clarity).

In FIG. 5, folded webs P2L on the left of center framework 15 are offset from P2L webs in FIG. 4 after advancement around turning bars 9 thus, separate framework for the slitting/folding section and the transverse section are preferred.

FIGS. 3–6 show eight parallel webs being split into two pluralities for processing over anvil rolls 19 and 21. It is noted that additional intermediate frames can be added for narrower anvil/knife roll units to span the distance between side frames.

The arrangement of FIG. 1 with two pluralities of webs is preferred rather than three or more streams of product webs to minimize carrier cylinder diameter and circumferential space required for mounting additional cutoff units and therefore minimize carrier cylinder diameter.

Figure 8:
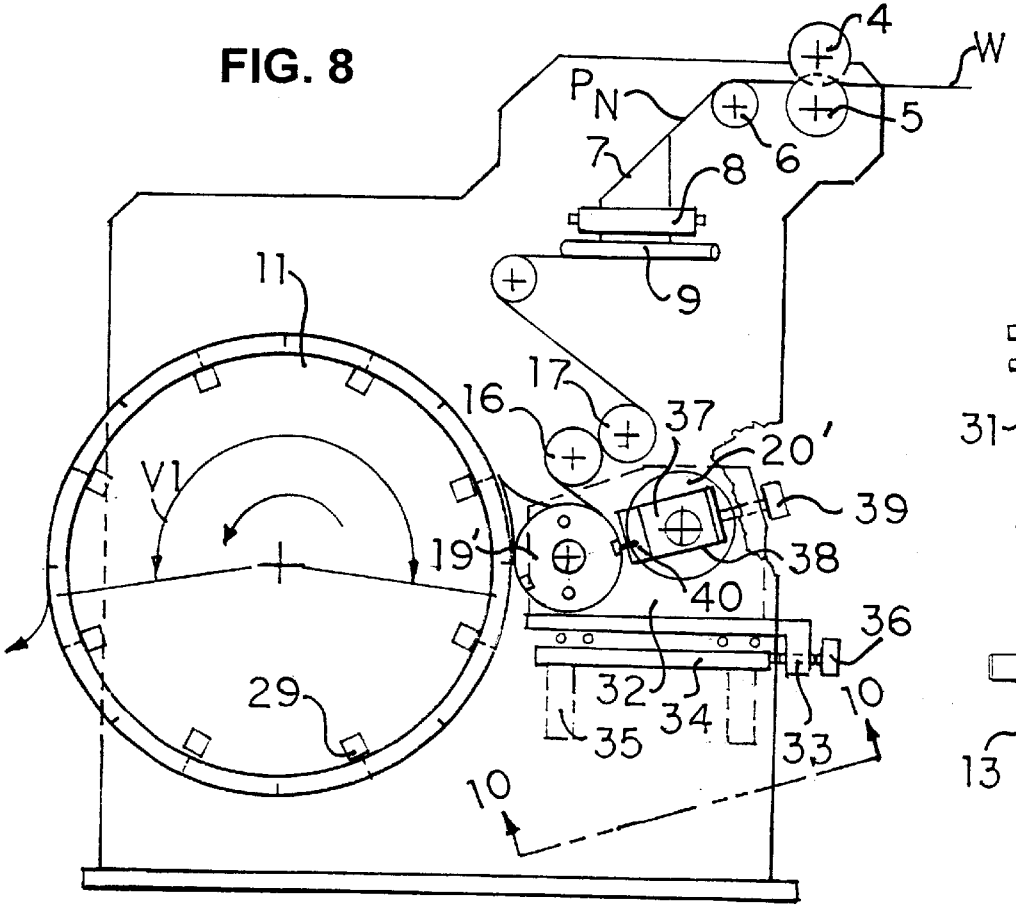
FIG. 8 is a side view schematic of apparatus for slitting a single web into a plurality of product width webs illustrating the arrangement of anvil/knife coacting roll couples with nip adjustments in 1-wide frames supported by a cross member between apparatus side frames.

In FIGS. 6 and 8, web processing speed is equal to the surface speed of the carrier cylinder.

In FIG. 8, a cutoff unit for each product width web is mounted in side frames 32 and attached to movable base 33 suppported by between frame supports 35, In FIG. 8, adjustment knob 36 collared in plate 34 moves extended base 33 and roll 19' for nip adjustment between anvil roll 19' and carrier cylinder 11.

Knife roll 20' is journaled in sliding block 37 slideably contained in cutouts 38 of side frames 32. Knob 39 adjusts contact between knife blades 40 (referenced at top of FIG. 10) and anvil blades (see 51 of FIG. 12).

Figure 9:
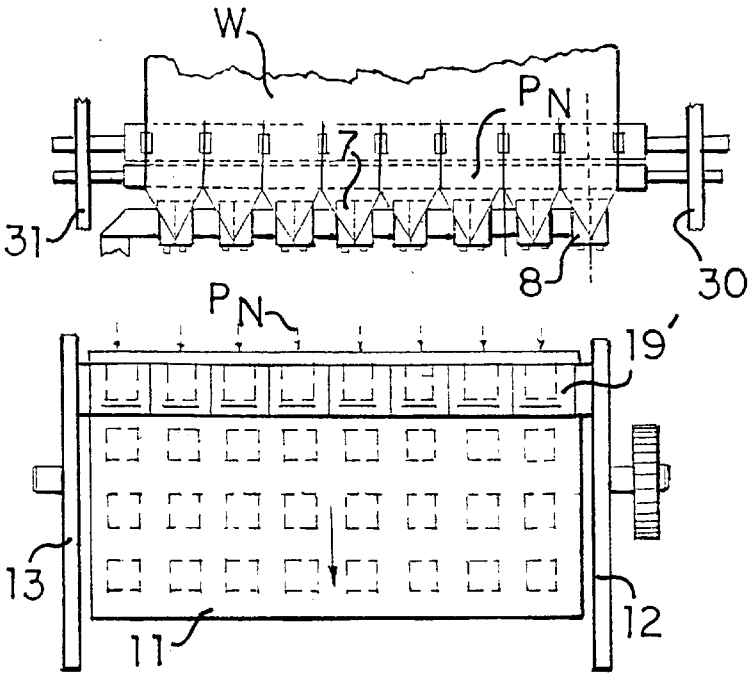
FIG. 9 is a plan view of the folding plates and anvil rolls of FIG. 8 illustrating segment sequencing and repeat distances after transverse folding. Metering and knife rolls are omitted for clarity.

In FIG. 9, parent web W slit into a plurality of product width webs $P_n$ is pulled by roll pair 8 over plates 7 and turned for advancement to anvil roll 19' (feed rolls 16, 17, and knife roll 20 are not shown for clarity)

In the arrangements of FIG. 8 and 9, all webs $P_n$ are juxtaposed or superposed along parallel paths and advanced by carrier cylinder 11 as shown.

Figures 10, 11, 12:
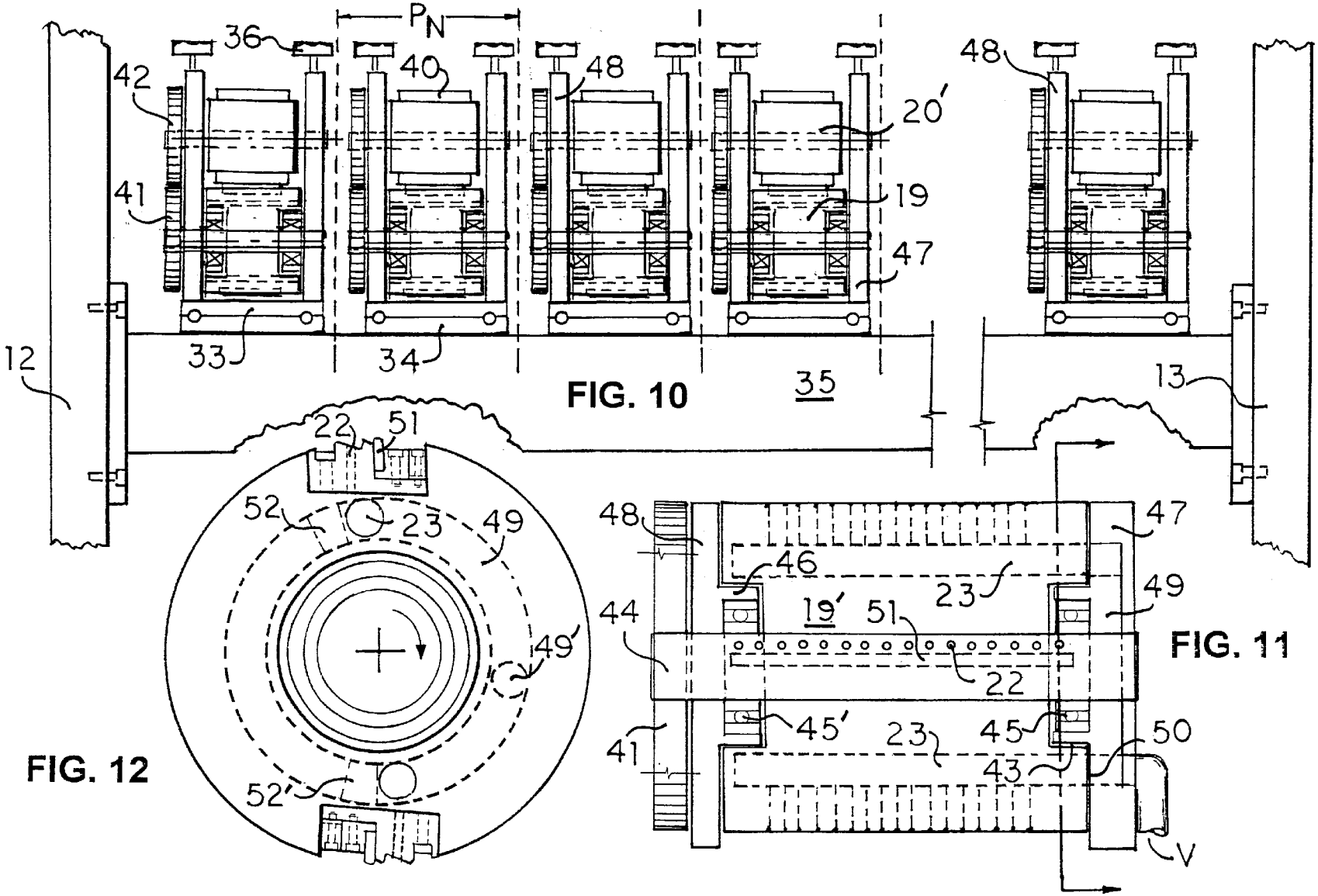
FIG. 10 is a schematic elevation of anvil/knife roll arrangement viewed from sight line 10—10 of FIG. 8 illustrating a plurality of product width anvil/knife rolls in juxtaposed relationship arranged along a common transverse line.
FIG. 11 is an enlarged side elevation of a single anvil roll of FIG. 10 with high vacuum conduits and ports for advancing a segment at the same speed as the carrier cylinder.
FIG. 12 is an enlarged end view of the anvil roll of FIG. 11 illustrating sliding contact with a vacuum valve (shown phantom) at one end.

In FIG. 10 a plurality of 1-wide cutoff units are supported on between frame cross member 35. Each unit of the plurality cuts a single folded web and transfers a cut segment to carrier cylinder 11 (see FIG. 8).

In FIG. 10 each cutoff unit is mounted within a transverse space equal to or les than the width of each slit product web $P_n$.

To achieve the objective of having a plurality of cutoff units mounted along only one transverse line (and minimize circumferential space requirements), the special adapation of FIG. 11 is used, it being noted that the anvil roll containment frame does not exceed the outer periphery of the roll for a pre-selected arcuate portion of its outer surface in order to permit contact with the carrier cylinder without interference between side frames 32 and the carrier cylinder when the anvil roll is in surface nip contact.

In FIG. 10, knob 36 for anvil to carrier nip adjustment is omitted for clarity.

Inter-roll gearing 41, 42 can be extended to drive metering rolls. or feed rolls can be motor driven (see 18 of FIG. 1).

In the later descibed embodiment of FIG. 13, feed rolls are geared or driven to advance the web at a speed lower than the surface speed of the anvil roll. Slow speed web advancement and the concurrent use of two web feed units results in slow web unwinding speed from each of two parent webs and the resultant longer running time between roll changes.

In FIG. 11, a solid anvil roll 19' has circular cutouts 43 on each end, is center bored for shaft 44, and rotates in end bearings 45, 45'.

The outer race of the bearing is non-rotatably held by annular bearing support extension 46 of side frame 48. Side frame 48 contains annular groove 49 that communicates with conduit 23, ports 22 and vacuum source V. The face of side frame 47 containing groove 47 is in sliding contact with face 50 of roll 19'.

In FIG. 12, vacuum valve annular groove 49 in side frame 47, vacuum source connection 49' and blocks 52, 52' are shown phantom as separate cooperating members that provide vacuum to ports 22 located adjacent anvil blade 51.

In the embodiment of FIG. 13, a lower plurality 53 of product width cutoff rolls comprising S-wrap metering roll set 54, knife roll 55 and anvil roll 56 are each supported between unit side frames 47, 48 (see FIG. 10).

In FIG. 13, side frames 47, 48, for each 1-wide cutoff unit frame base,and adjustment knobs are omitted for clarity, but as in FIG. 10, all compoonents are supported on cross members between main frames 12, 13.

In FIG. 13, lower unit 53 is supported on cross piece 57,and upper unit 53' from 58.

Figure 14:
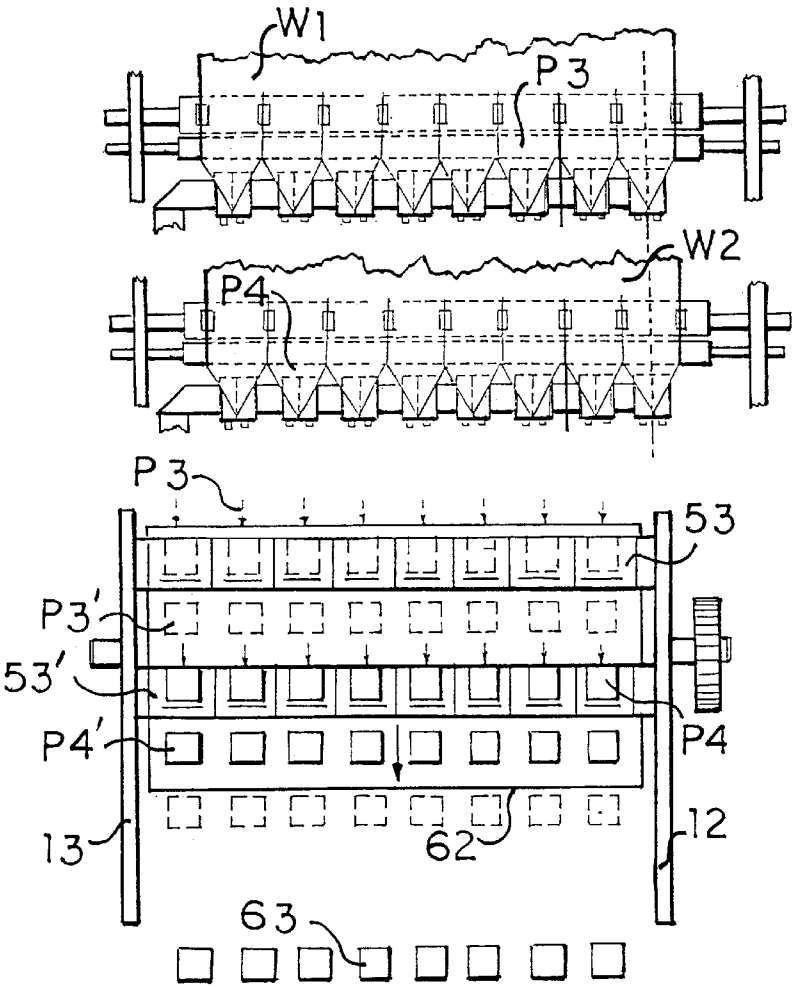
FIG. 14 is a plan view of the folding plate arrangements of FIG. 13 (spaced in machine direction for clarity) illustrating two anvil rolls in cooperating contact with the carrier cylinder surface to produce placement of folded segments from alternate webs on alternate repeat surfaces of the carrier.

In FIG. 13, both pluralities of cutoff units are juxtaposed as in FIG. 10 and arranged to advance webs according to the web arrangement shown in FIG. 14.

In FIG. 14, the schematic web arrangement includes a lower plurality of cutoff units 53 at the beginning (top) of the carrier path, and a second plurality 53' downstream.

Referring back to FIG. 13, full width web W1 advances through sllitters 59 and each product width web $P_3$ is threaded around S-wrap roll set 54 for slow speed advancement to the surface of anvil roll 55 for cutting by knife roll 56.

In FIG. 13, a 2-time anvil roll 55 having a circumferece of two product repeats has only one anvil 57 which coacts with a single knife blade 61 mounted in roll 56.

Typical web processing speed is about 450 fpm.

In FIG. 13, webs W1 and W2 are advanced at 225 fpm and therefore, consecutive cut segments will be placed on alternate repeat surfaces of the anvil rolls 55, 55' for transfer to alternate repeat surfaces of the carrier cylinder 11.

In FIG. 13, as carrier 11 rotates, the first segment transferred from first anvil roll 55 is folded while advancing with the carrier.

Simultaneously, a second segment is transferred from second anvil roll 55' to every second repeat surface between segments already deposited by the first anvil roll.

In the lower portion of FIG. 14, an eight wide plurality of folded segments $P_4$ from upper cutoff assembly 53' are shown rotating toward a takeaway position 62 following a previously discharged plurality of 8 folded segments from anvil roll 53.

As described above, each successive plurality of segments placed on the first anvil roll is folded and transferred to alternate repeat surfaces of the carrier. Likewise, product from the second anvil roll is placed on alternate unoccupied repeat surfaces of the carrier. In effect, at the takeaway position 62, each repeat of the carrier has a folded segment to produce a consecutive uninterrupted series of folded sements for takeaway, as represented by pluralty 63.

Figure 15:
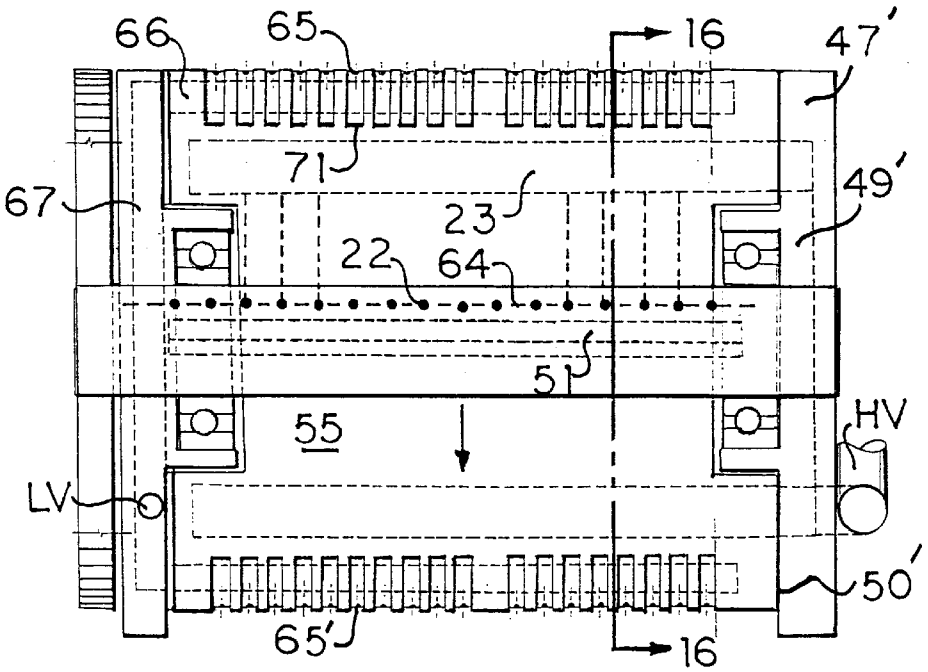
FIG. 15 is a side elevation of a combination anvil roll having high vacuum ports for positive advancement and transfer and low vacuum ports for slipping reduced speed advancement of single width webs. Two required unwind stands are omitted for brevity.

In FIG. 15, anvil roll 55 has a transverse line of ports 64 adjacent anvil blade 51. Ports 64 are activated with high vacuum to grip and accelerate a cut segment after the proper repeat length has been advanced beyond the knife/anvil nip at a speed slower than the surface speed of anvil and carrier rolls.

In FIG. 15, side frame 47' is similar to the fixed frame 47 of FIG. 11 and includes annular groove 49' in sliding contact with high vacuum source HV, conduits 23, and ports 22. (adjacent anvil 51' in the middle of FIG. 15).

As described above, S-wrap metering rolls 54 advance the web one segment length while the anvil roll rotates two segment lengths during one revolution.

During the slow speed advancement, the web is held in slipping engagement with the surface of the anvil roll by low vacuum LV applied throught ports 65 in communication with low vacuum conduits 66, grooves 67 and vacuum source LV.

Thus, for 2-time repeat rolls, a single anvil coacting with a single knife severs one segment for each revolution of two repeat surfaces.

In FIG. 15, intermediate rows of ports are omitted to show other elements.

In FIG. 16, high vacuum channels to ports 22 are drilled through anvil mounting blocks 69.

In FIG. 16, a low vacuum source (see LV in FIG. 15) applies low vacuum suction to groove 67 (shown more clearly in FIG. 15) and with rotating sliding contact, to low vacuum conduits 66 and ports 70.

Referring briefly to FIG. 15, anvil roll 55 includes a plurality of circumferential grooves 71.

In FIG. 16, connections to low vacuum conduits 66 near the roll periphery and connecting passages to ports 70 can be pre-molded in a flexible strip or molded arcuate shape (about 160 degrees in FIG. 16) for insertion into grooves 71.

Figure 17:
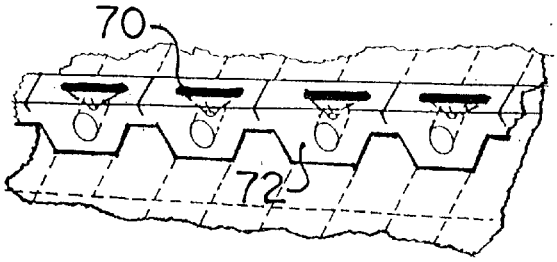
FIG. 17 is a perspective view of groove inserts with pre-molded channels for portions of the anvil roll of FIG. 15

In FIG. 17, member 72 having slotted ports 70 are inserted in grooves 71, and drilled for insertion of a circular tube in conduit 66 to hold the inserts in place. After insertion, holes are drilled through the circular tube walls.

Figure 18:
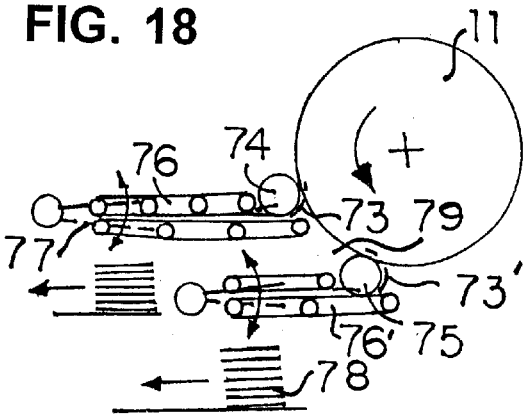
FIG. 18 is a side elevation of a dual delivery system illustrating multiple takeaway locations for stacks from carrier cylinders in FIGS. 1, 8, and 13.

In FIG. 18, carrier delivers product serially at full speed in a stream taken from the surface path at one of two locations.

For positive removal and transfer to roll 73, stripper fingers 73, 73' inserted in grooves (not shown).

In FIG. 18, stripper 73 and transfer roll 74 advance a consecutive series of folded product.

When a pre-selected count is registered, vacuum to ports on transfer roll 74 is interrupted and segments are advanced to takeaway roll 75 by stripping fingers 73' for entrapment between upper and lower belts of system 76.

Before stack 78 reaches the pre-selected count, vacuum grooves for transfer roll 74 and carrier 11 are energized while a pre-determined plurality of product has passed roll 74 and is transferred to roll 75 for completion of a pre-selected count for stack 78.

Thus, for multiple takeaway positions, the timing and duration of multiple vacuum grooves for carrier 11 vacuum (see FIG. 19) and transfer roll 74,75 vacuum are selectively changed by programmable switching.

Figure 19:
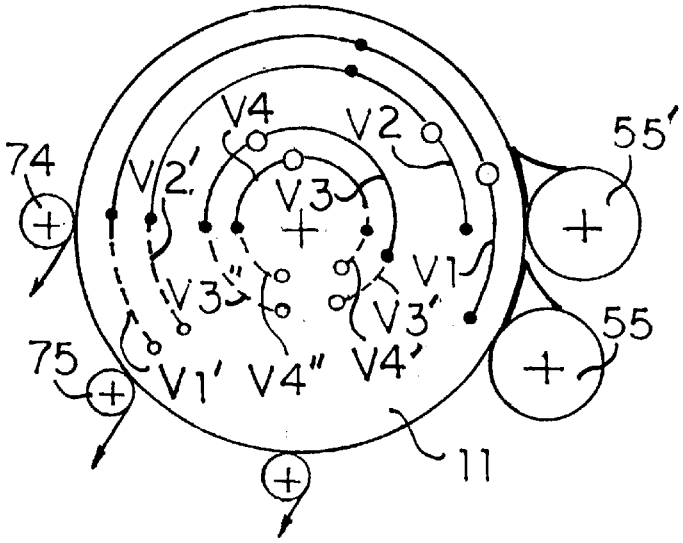
FIG. 19 is a diagrammatic illustration of typical vacuum groove timing and duration for dual delivery systems of FIG. 18.

In FIG. 19, timing and duration for high vacuum applied to fold line ports in the carrier surface are shown as V1 for segments transferred by anvil roll 55, V2 by second anvil roll 55'.

Since the anvil rolls are spaced on the carrier periphery, different vacuum start positions for V1, V2 are indicated.

For brevity, vacuum grooves to apply vacuum to transfer rolls 74, 75 are also shown in FIG. 19, it being understood that the vacuum valves for carrier functions and transfer roll functions are in surface contact with the related rolls.

In FIG. 19, a continuous stream of segments is placed on alternate carrier repeats by spaced anvil rolls 55, 55' for delivery via roll 74.

When stack count is completed, carrier vacuum paths V1 and V2 (shown solid) must be extended to advance all segments to takeaway roll 75 and lower belt system 76' (see FIG. 18).

In FIG. 19, upon stack count completion for upper belt delivery system 76, vacuum path V3 expires and carrier vacuum is extended as at V1 or V2' for further advancement of segments to bottom takeaway roll 75.

Thus, the start of V4 must be advanced as at V4' to carry the leading segments of the next count forward from roll 74 to roll 75.

Since there are one or more repeat lengths 79 on the carrier surface between rolls 74, 75, the start of V3 must be advanced as at V3' to begin transferring the next stack sequence to roll 74 before the trailing segments of the previous stack are delivered via roll 75.

The delay and extension of paths (like V4') are a function of space between takeaway rolls, number of roll positions, etc, and are predetermined for digital switching of different stack paths and stack counts.

Dellivery and packout still occurs at full speed of about 450 deliveries per min, but dual takeaway and stacking allows more time for stack handling between counts.

Figure 20:
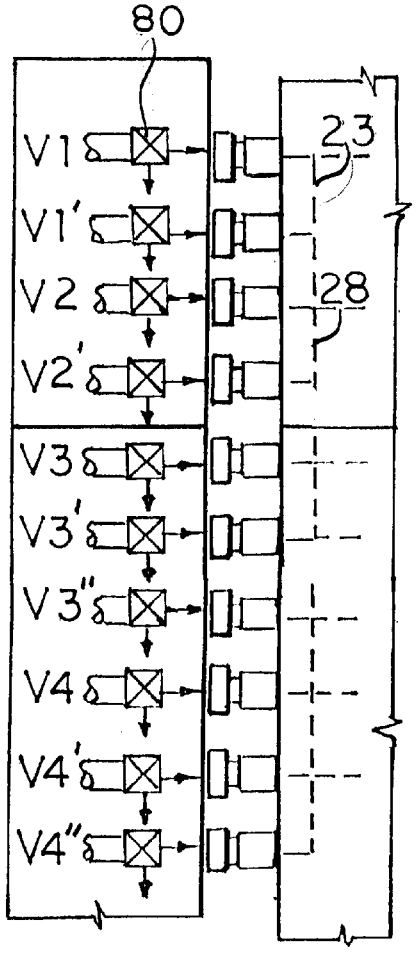
FIG. 20 is a schematic illustration of digitally controlled electronic valving for the dual delivery takeaway of FIG. 18.

In FIG. 20, vacuum connections V1, V2, etc. communicate with respective conduits in carrier cylinder 11, and V1', V2' show carrier vacuum path extensions as required for switching from 74 to 75 or vice versa.

Similar connections for V3 and V4 are required to extend and advance paths V3', V4', and/or extend and delay paths as at V3" and V4".

Each vacuum line contains a digitally activated valve 80 to shut off vacuum by opening vacuum inlet to ambient room conditions or alternatively, closing the line and applying vacuum.

It is furthermore to be understood that the present invention may be embodied in other specific forms without departing from the spirit or special attributes, and it is therefore, desired that the present embodiments be considered in all aspects as illustrative and, therefore, not restrictive, reference being made to the appended claims rather than to the foregoing description to indicate the scope of the invention.

Having thus described the invention, what is desired to protect by Letters Patent are the following:

1. An article folding apparatus comprising:

a plurality of side frames to support;

means for advancing a web, means to slit said web into a pluraliuty of juxtaposed product width webs, means to longitudinally fold, turn, advance and cut said webs into segments, means to advance said segments along a carrier cylinder path, a carrier means intermediate one of said side frame pluralities to support;

means to meter advancement of at least two pluralties of said juxtaposed longitudinally folded product webs, at a speed slower than the surface speed of said carrier, a plurality of means to cut said product webs into segments, each of said means circumferentially spaced at least one product repeat from the other of said segment cutting means, each including a cooperating anvil/knife roll couple, each of said anvil rolls including low vacuum apertures for slipping advancement of said slower speed web, and high vacuum apertures for gripping advancement of said cut segment at a speed equal to the surface speed of said carrier, said anvil roll including high vacuum conduits communicating with surface apertures and a vacuum source via a cooperating valve means to grip, uplift, and release a leading portion of a segment.

said carrier cylinder including means to secure and advance a trailing portion of said segment, said means including conduits arranged along a transverse line on said carrier cylinder and in communication with surface ports and a vacuum source, said anvil roll including means to interrupt said vacuum to release said leading panel for folded superposition over said trailing portions to complete a fold as said trailing portions advance.

means to remove said folded segment from said carrier path.

2. The apparatus of claim 1 including at least two cutoff units each including metering rolls and a co-acting anvil/knife roll pair, wherein one end of said co-acting rolls are rotatably supported within a bearing housing contained in said intermediate frame member, each of said roll pairs transversely and circumferentially spaced from the other.

3. The apparatus of claim 1 wherein said support means between side frames supports a plurality of segment cutoff means, each cutoff means including an anvil roll with drilled vacuum conduits in communication with an annular vacuum groove contained within anvil roll containment frames, said containment frames supported by said intermediate member.

4. The apparatus of claim 1 wherein the speed of product width webs is equal to the surface speed of said carrier cylinder divided by the number of circumferentially spaced cutoff unit pluralties, each unit of said plurality arranged along a transverse line for processing a plurality of webs equal to the width of said parent web.

5. The apparatus of claim 1 wherein said plurality of cutoff units includes at least two juxtaposed circumferentially spaced anvil—knife roll couples supported between side frames and at least one intermediate frame portion.

6. The apparatus of claim 1 wherein said pluraliry of cutoff units includes juxtaposed coacting anvil—knife roll couples each rotatably mounted in side framework supported by a cross member affixed to side frames of said folding apparatus.

7. The apparatus of claim 1 wherein said closed interior conduits of said carrier cylinder include a pre-formed shape attached to the inside of said carrier cylinder to form a closure for vacuum.

8. The apparatus of claim 1 wherin the surface speed of said product web feed rolls is equal to the surface speed of said anvil roll.

9. The apparatus of claim 1 wherein said segment cutoff anvil/knife roll pair includes only one anvil blade and only one knife blade for each plurality of roll repeats.

10. The apparatus of claim 1 wherein said cutoff unit framework includes means to adjust the nip between said anvil roll and said carrier cylinder.

11. The apparatus of claim 1 wherein said cutoff unit framework includes means to adjust anvil/knife contact pressure between said rolls.

12. The apparatus of claim 1 including means to rotate said carrier cylinder and said anvil/knife roll pair in syncronism and means to separately rotate said product width feed rolls at a pre-determined ratio of said synchronous speed.

13. The apparatus of claim 1 wherein said anvil roll includes a plurality of inwardly extending annular bearing support flanges extending inwardly from anvil/knife roll supporting side frames.

14. The apparatus of claim 1 wherein side frames for single product width anvil/knife rolls include annular anvil vacuum grooves.

15. The apparatus of claim 1 wherein said anvil roll(s) for advancing webs at a speed less than carrier surface speed are rotatably mounted in frames having an annular vacuum groove in each side member, one groove for communication with a high vacuum source and surface ports, and the other for communication with a lower vacuum source and surface apertures.

16. The apparatus of claim 1 wherein a vacuum source communicates with vacuum ports in the surface of said carrier cylinder via shaped closed conduits in contacting attachment to the inside surface of said carrier and cooperating with vacuum conduits drilled in said anvil roll from at least one end of said roll to complete a transverse fold.

17. The apparatus of claim 1 wherein a vacuum source communicates with ports aligned transversely in close proximity to said anvil blade and a reduced vacuum source communicating with surface apertures located between said ports.

18. The apparatus of claim 1 wherein at least a portion of the anvil roll supporting frame is equal to or less than the outside diameter of said roll.

* * * * *